US010262612B2

(12) United States Patent
Wang

(10) Patent No.: US 10,262,612 B2
(45) Date of Patent: Apr. 16, 2019

(54) SCAN COMPENSATION METHOD AND SCAN COMPENSATION CIRCUIT OF GATE DRIVER

(71) Applicant: Shenzhen China Star Optoelectronics Technology Co., Ltd., Shenzhen, Guangdong (CN)

(72) Inventor: Zhao Wang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 257 days.

(21) Appl. No.: 15/309,185

(22) PCT Filed: Aug. 16, 2016

(86) PCT No.: PCT/CN2016/095501

§ 371 (c)(1),
(2) Date: Nov. 6, 2016

(87) PCT Pub. No.: WO2017/211008

PCT Pub. Date: Dec. 14, 2017

(65) Prior Publication Data

US 2018/0190226 A1 Jul. 5, 2018

(30) Foreign Application Priority Data

Jun. 7, 2016 (CN) ..... 2016 1 0397934

(51) Int. Cl.
*G09G 3/36* (2006.01)

(52) U.S. Cl.
CPC ..... *G09G 3/3674* (2013.01); *G09G 3/36* (2013.01); *G09G 2310/0213* (2013.01); *G09G 2310/08* (2013.01)

(58) Field of Classification Search
CPC ..... G09G 3/3674; G09G 2310/08; G09G 2310/0213
See application file for complete search history.

(56) References Cited

U.S. PATENT DOCUMENTS 8,026,868 B2 * 9/2011 Bae ..... G09G 3/298 345/213
9,824,653 B2 * 11/2017 Park ..... G09G 3/3614
(Continued)

FOREIGN PATENT DOCUMENTS

CN 1648987 A 8/2005
CN 102402033 A 4/2012
(Continued)

*Primary Examiner* — Nelson M Rosario
*Assistant Examiner* — Scott Au
(74) *Attorney, Agent, or Firm* — Text

(57) ABSTRACT

The present disclosure provides a scan compensation method and a scan compensation circuit of a gate driver. The scan compensation method comprises: when the gate driver switching from first scanning mode to second scanning mode or from second scanning mode to first scanning mode, performing a first operation to a clock signal and a first compensation signal of the gate driver, and performing a second operation to the obtained signals and a second compensation signal, wherein the first scanning mode is a sequential scan mode, the second scanning mode is non-sequential scan mode.

4 Claims, 5 Drawing Sheets

(56) References Cited

U.S. PATENT DOCUMENTS

| | | | | |
|---|---|---|---|---|
| 2002/0190934 | A1* | 12/2002 | Yoshida | G09G 3/3216 345/76 |
| 2008/0036497 | A1* | 2/2008 | Chung | G09G 3/3266 326/83 |
| 2012/0169678 | A1* | 7/2012 | Shin | G09G 3/20 345/204 |

FOREIGN PATENT DOCUMENTS

| | | | |
|---|---|---|---|
| CN | 102903341 | A | 1/2013 |
| CN | 204857151 | U | 12/2015 |
| JP | 2008026800 | A | 2/2008 |

* cited by examiner

SCAN COMPENSATION METHOD AND SCAN COMPENSATION CIRCUIT OF GATE DRIVER

BACKGROUND OF THE DISCLOSURE

1. Field of the Disclosure

The present disclosure relates to a liquid crystal display field, and in particular to a scan compensation method and a scan compensation circuit of a gate driver.

2. The Related Arts

In recent years, the liquid crystal display, LCD, gradually replaces the conventional cathode ray tube, CRT, display because of its small size, light weight, low power consumption and high display quality. The application of liquid crystal display is gradually expanding, which has evolved from the displays of audio and video products, notebook computer monitor and so on to desktop computers, monitors of engineering workstations, EWS, and so on.

The drive of liquid crystal display is to establish a driving electric field through adjusting phase, peak value, frequency and so on of the potential phase applied on the liquid crystal device electrode, in order to achieve the display effect of the liquid crystal device. The driving methods of liquid crystal display are many, the common driving method is dynamic driving method. When the pixels displayed on the liquid crystal display device are many (for example a dot matrix liquid crystal display device), in order to save the huge hardware driver circuit, processing the production and arrangement of the liquid crystal display device electrode, achieving the array structure, namely, connecting and leading the back electrode of a group of display pixels in horizontal, which calls column electrode. On the liquid crystal display device, each display pixel is confirmed by the location of column and row. The driving method correspondingly adopts the grating scan method similar to CRT. The dynamic driving method of liquid crystal display is cyclically applied the selection pulse to the row electrode (namely scanning the row), at the same time, all column electrodes of display data provide the corresponding selection or non-selection driving pulse, thereby achieving the display function of all display pixels of one row. The row scan is progressively and sequentially carried on, the cycle is very short, making the liquid crystal display stably display.

However, in the sequential scan mode, in several special circumstances of heavy load, the power of source driver will greatly increase, at the same time, the heat increases, it brings the risk to the normal operation of liquid crystal display. In order to optimize the operation state of liquid crystal display in such special circumstance of heavy load, a new non-sequential scan technology of gate driver has been provided. For example, in the normal screen, the scanning method of the gate driver is sequential scan mode, when detecting the heavy load, the scanning formula of the gate driver will be switched to non-sequential scan mode. According to the difference of display screen, able to switch between the sequential scan mode and non-sequential scan mode in unit of frame. Although using non-sequential scan can greatly reduce the power consumption and temperature of the source driver under several special circumstances (for example heavy load), there is still some disadvantages, one is because the potential holding time of liquid crystal capacitance, LC, between different rows is different and may occur stripe sense of the display screen. Therefore, in order to improve the display quality, the further optimized design of the gate driver is required.

SUMMARY OF THE DISCLOSURE

In order to overcome the deficiencies of the prior art, the exemplary embodiments of the present disclosure provides a scan compensation method of the gate driver, which can reduce that the potential holding time affect the display through the row that the potential holding time of liquid crystal capacitor is changed since the scan sequence is changed.

According to one aspect of the exemplary embodiment of the present disclosure, providing a scan compensation used for a gate driver, wherein the scan compensation method comprises: when the gate driver switching from first scanning mode to second scanning mode or from second scanning mode to first scanning mode, performing a first operation to a clock signal and a first compensation signal of the gate driver, and performing a second operation to the obtained signals and a second compensation signal, wherein the first scanning mode is a sequential scan mode, the second scanning mode is non-sequential scan mode.

Preferably, the first operation is OR operation, the second operation is AND operation.

Preferably, the first compensation signal is use to reduce the degree of corresponding potential retention time increasing which is caused by mode switching of the gate driver, the second compensation signal is used to reduce the degree of corresponding potential retention time which is caused by mode switching of the gate driver decreasing.

Preferably, when the gate driver switches from the first scanning mode to the second scanning mode or from the second scanning mode to the first scanning mode, when m-th row of multiple rows of a liquid crystal display is scanned in n-th order, if m is less than n, aligning the falling edge of the first compensation signal and the rising edge of n-th cycle waveform of a clock signal of the driver in order to perform the first operation, if m is greater than n, aligning the falling edge of the second compensation signal and the rising edge of n-th cycle waveform of a clock signal of the driver in order to perform the second operation, if m is equal to n, in n-th cycle of the clock signal of the driver does not perform the first operation or the second operation, wherein n and m are positive integers.

According to another aspect of the exemplary embodiment of the present disclosure, providing a scan compensation circuit used for gate driver, wherein the scan compensation circuit comprises: a first compensation circuit, which is disposed to perform a first operation to a clock signal and a first compensation signal of the gate driver when the gate driver switching from first scanning mode to second scanning mode or from second scanning mode to first scanning mode; a second compensation circuit, which is disposed to perform a second operation to output signal of the first operation and a second compensation signal when the gate driver switching from first scanning mode to second scanning mode or from second scanning mode to first scanning mode, wherein the first scanning mode is a sequential scan mode, the second scanning mode is non-sequential scan mode.

Preferably, the first operation is OR operation, the second operation is AND operation.

Preferably, the first compensation signal is use to reduce the degree of corresponding potential retention time increasing which is caused by mode switching of the gate driver, the second compensation signal is used to reduce the degree of corresponding potential retention time which is caused by mode switching of the gate driver decreasing.

Preferably, wherein when the gate driver switches from the first scanning mode to the second scanning mode or from the second scanning mode to the first scanning mode, when m-th row of multiple rows of a liquid crystal display is scanned in n-th order, if m is less than n, aligning the falling edge of the first compensation signal and the rising edge of n-th cycle waveform of a clock signal of the driver in order to perform the first operation, if m is greater than n, aligning the falling edge of the second compensation signal and the rising edge of n-th cycle waveform of a clock signal of the driver in order to perform the second operation, if m is equal to n, in n-th cycle of the clock signal of the driver does not perform the first operation or the second operation, wherein n and m are positive integers.

According to the scan compensation method and scan compensation circuit of the gate driver provided by the exemplary embodiments of the present disclosure, which can reduce that the potential holding time affect the display through the row that the potential holding time of liquid crystal capacitor is changed since the scan sequence is changed.

The other aspect of the exemplary embodiment will be described as below, and the part of which will be obviously, or can be known by the practice of the present disclosure.

BRIEF DESCRIPTION OF THE DRAWINGS

Through combining the following drawings to describe the embodiments, the above and/or other purpose and advantages of the present disclosure will be more clearly, wherein.

DETAILED DESCRIPTION OF THE PREFERRED EMBODIMENTS

Figure 1A:
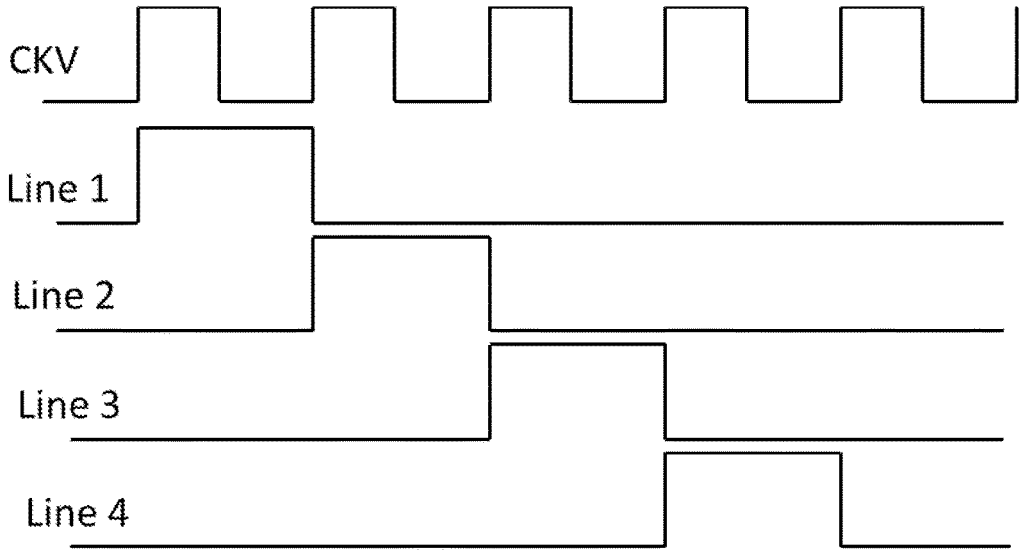
FIG. 1A is a schematic diagram of the sequence of the row scanned in first scanning mode according to the exemplary embodiment of the present disclosure.

Exemplary embodiments will now be described in detail, the exemplary embodiments are illustrated in the drawings, wherein the same reference numbers refer to the same elements. In this regard, the exemplary embodiments may have different forms and should not be construed as limited to the description set forth herein. Therefore, the following will describe the exemplary embodiment through only referring the drawings in order to explain various aspects of the inventive concept. As used herein, the term "and/or" includes one or more listed items related to any and all combinations. When such as " . . . in at least one" the statement is after a column of element, the statement modifies the entire column element, instead of modifying a single element of the column.

The terminology used herein is only for describing particular embodiments, and is not intended to limit the exemplary embodiments of the present invention. As used herein, unless the context clearly indicates otherwise, the singular forms are intended to include the plural forms. In addition, it should be understood that, when used in this specification, the term "comprising" and/or "including", which indicates the presence of stated features, integers, steps, operations, elements, and/or components, but do not preclude the presence or attach one or more other features, integers, steps, operations, elements, components, or combinations thereof.

It should be understood that, although the terms used herein may be a first, second, third, etc., to describe various elements, components, regions, layers and/or sections, these elements, components, regions, layers and/or sections should not limited by these terms. These terms are only used to distinguish one element, component, region, layer or section from another element, component, region, layer or section. Thus, a first element discussed below, component, region, layer or section may be termed a second element, component, region in the present invention without departing from the teachings of the premise, layer or section.

Unless otherwise defined, all terms used herein (including technical and scientific terms), and the inventive concept having ordinary skill in the art as commonly understood meaning of the same meaning. It is also understood, unless expressly so defined otherwise, the terms (terms, such as in the general dictionary definition) should be interpreted as having their environmental related field and/or the present specification consistent with their meaning of meaning and will not be idealized or overly formal sense to explain them.

It should also be noted that in some alternative implementations, the shown operation may not be in the order shown in the figure occurs. For example, two drawings shown in succession may in fact be executed substantially concurrently, or may sometimes be executed sequentially contrary, depending on the function may be involved.

Reference will now be described more fully with reference to an exemplary embodiment. In the drawings, for clarity, and the thickness of layers and regions are exaggerated. Similar numerals in the figures refer to like elements throughout, and therefore the description thereof will be omitted.

FIG. 1A is a schematic diagram of the sequence of the row scanned in first scanning mode according to the exemplary embodiment of the present disclosure.

Figure 1B:
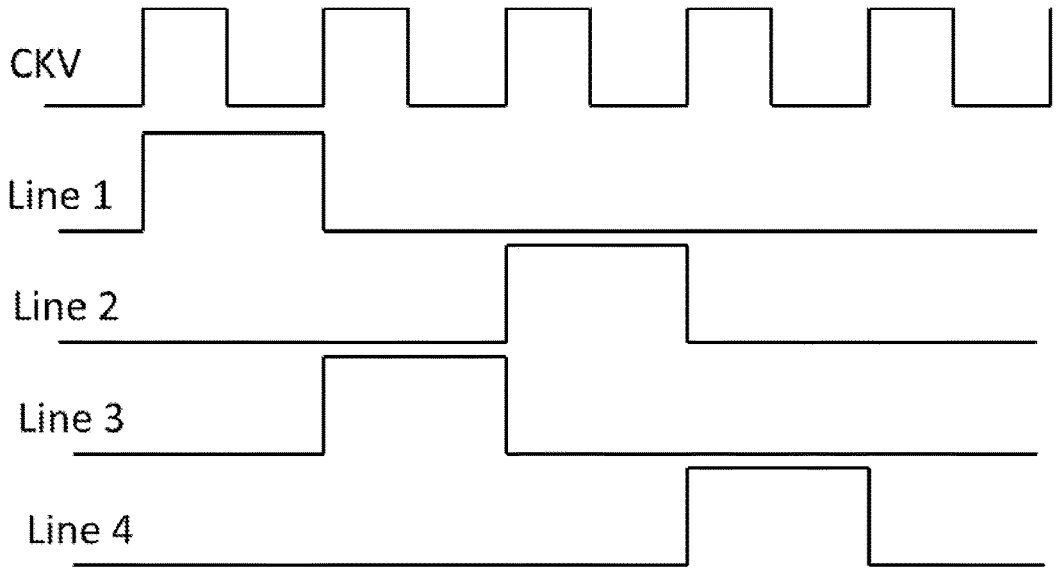
FIG. 1B is a schematic diagram of the sequence of the row scanned in second scanning mode according to the exemplary embodiment of the present disclosure.

Refer to FIG. 1, take performing scan to four rows (such as L1, L2, L3 and L4) for example. Herein, the term "row" refers to the row of pixel. Scanning the pixel row may also be called turning on the pixel row. In the first scanning mode (also called "sequential scan mode"), the scan to each row is progressive scan (namely from top to bottom). For example, according to the gate signal CKV outputted by the gate driver, scanning L1 at first, scanning L2, scanning L3, and scanning L4 at last. The gate signal CKV is periodic signal, each cycle corresponds to a row scan. However, when some special circumstances (for example heavy load screen) occur, performing scan in the sequential scan mode will cause the power of the source driver greatly increasing, increasing the heat, it is not conducive to the normal operation of the liquid crystal display. The following will refer to the example that performing row scan in the second scanning mode (also called "non-sequential scanning mode") described in FIG. 1B.

FIG. 1B is a schematic diagram of the sequence of the row scanned in second scanning mode according to the exemplary embodiment of the present disclosure.

Refer to FIG. 1B, still take performing scan to four rows (such as L1, L2, L3 and L4) for example. In order to optimize the operation state of the liquid crystal display in the heavy load screen, when detecting the heavy load, the gate driver is switched from the first scanning mode (namely sequential scan mode) to the second scanning mode (namely non-sequential scan mode). In the second scanning mode, the scan for each row is not from top to bottom. For example, according to the gate signal CKV outputted by the gate driver, scanning L1 at first, scanning L3, scanning L2, and scanning L4 at last. Therefore, as shown in FIG. 1A and FIG. 1B, according to the display screen, it is able to switch between the first scanning mode and the second scanning mode in unit of frame according to the scan sequence of the gate signal.

Although using non-sequential scan can greatly reduce the power consumption and temperature of the source driver under several special circumstances, there are still some disadvantages. For example, in the sequence scan mode, for each row, because the turning on time of each frame of the row is the same, when switching frame, after charge completing, the potential holding time (as shown in FIG. 1, the low potential stage of each row is of the liquid crystal capacitor of each row is namely the potential holding stage of the liquid crystal capacitor) the same. However, when switching from the sequential scan mode to the non-sequential scan mode and scanning each row, the turning on time of some rows will be changed, therefore, the difference of potential holding time of these rows may cause the stripe sense of the display screen. Therefore, the further optimization of gate driver is required.

Figure 2:
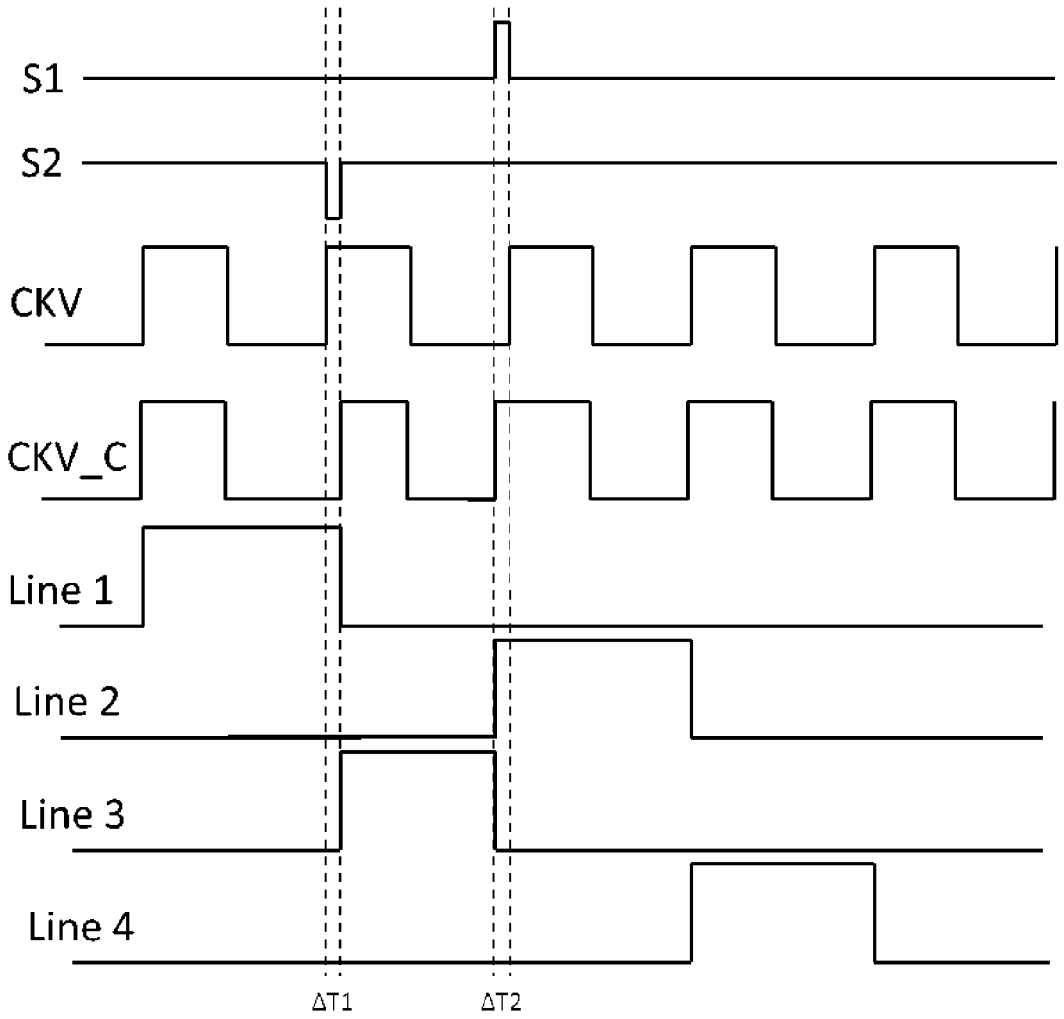
FIG. 2 is a illustrative diagram that using scan compensation method to perform row scan to the gate driver from the first scanning mode to the second scanning mode according to the exemplary embodiment of the present disclosure.

FIG. 2 is a illustrative diagram that using scan compensation method to perform row scan to the gate driver from the first scanning mode to the second scanning mode according to the exemplary embodiment of the present disclosure.

Refer to FIG. 2, the signal generated by the clock signal CKV of the gate driver and the first compensation signal as well as the second compensation signal executing the first operation and the second operation is CKV_C. The operated signal CKV_C is used for clock signal of the gate driver. As the above description, when the gate driver is switched from the first scanning mode to the second scanning mode, since the turning on time of the row is changed, the corresponded potential holding time of the row is also changed. For example, the potential holding time of L1 and L4 is not changed, the turning on time of L2 is delay, and the turning on time of L3 is in advance. Since the turning on time of L2 is delay, the potential holding time increases. In this point, for the L2 that the turning on time is delay, aligning the rising edge of the clock signal CKV of the corresponded gate driver and the falling edge of the first compensation signal S1, thereby adjusting the waveform of corresponded cycle of the operated signal CKV_C through executing the first operation (namely OR operation). As shown in FIG. 2, since the scan signal is triggered by the rising edge of the clock signal CKV_C, L2 is turned on in advance due to the affection of first compensation signal S1, thereby making the increase degree of potential holding time of L2 caused by switching to the second scanning mode corresponding decrease. Namely, the increase value of the potential holding time of L2 is reduced, the reduced value is represented as ΔT2. In other words, the first compensation signal S1 can be used to reduce the increase degree of the potential holding time corresponded to the row caused by switching the mode of gate driver. On the other aspects, for L3 that the turning on time is in advance, aligning the rising edge of the clock signal CKV of the corresponded gate driver and the falling edge of the second compensation signal S2, thereby adjusting the waveform of corresponded cycle of the operated signal CKV_C through executing the second operation (namely AND operation). As shown in FIG. 2, since the scan signal is triggered by the rising edge of the clock signal CKV_C, L3 is delayed to be turned on due to the affection of second compensation signal S2, thereby making the decrease degree of potential holding time of L3 caused by switching to the second scanning mode corresponding decrease. Namely, the decrease value of the potential holding time of L3 is increased, the increased value is represented as ΔT1. In other words, the second compensation signal S2 can be used to reduce the decrease degree of the potential holding time corresponded to the row caused by switching the mode of gate driver. According to the exemplary embodiments of the present disclosure, ΔT1 and ΔT2 can be adjusted. ΔT1 and ΔT2 can adjusted according to the actual display screen.

Similarly, when the gate driver is switched from the second scanning mode to the first scanning mode, the potential holding time of each row is also changed. For example, in the exemplary embodiment, in order to recover the progressive sequence scan, the turning on time of L2 needs to be in advance, the turning on time of L3 needs to be increase. Meanwhile, for L2 that the turning on time is in advance, aligning the rising edge of the clock signal CKV of the corresponded gate driver and the falling edge of the second compensation signal S2, thereby adjusting the waveform of corresponded cycle of the operated signal CKV_C through executing the second operation (namely AND operation). Therefore, L2 is delayed to be turned on due to the affection of second compensation signal S2, thereby making the decrease degree of potential holding time of L2 caused by switching to the first scanning mode corresponding decrease. On the other aspects, for the L3 that the turning on time is delay, aligning the rising edge of the clock signal CKV of the corresponded gate driver and the falling edge of the first compensation signal S1, thereby adjusting the waveform of corresponded cycle of the operated signal CKV_C through executing the first operation (namely OR operation). Therefore, L3 is turned on in advance due to the affection of first compensation signal S1, thereby making the increase degree of potential holding time of L3 caused by switching to the first scanning mode corresponding decrease.

According to the above exemplary embodiments, through adjusting the degree of potential holding time of L2 and L3 caused by switching the scanning mode, which can significantly reduce the negative impacts such as the stripe sense of display screen and so on.

Figure 3A:
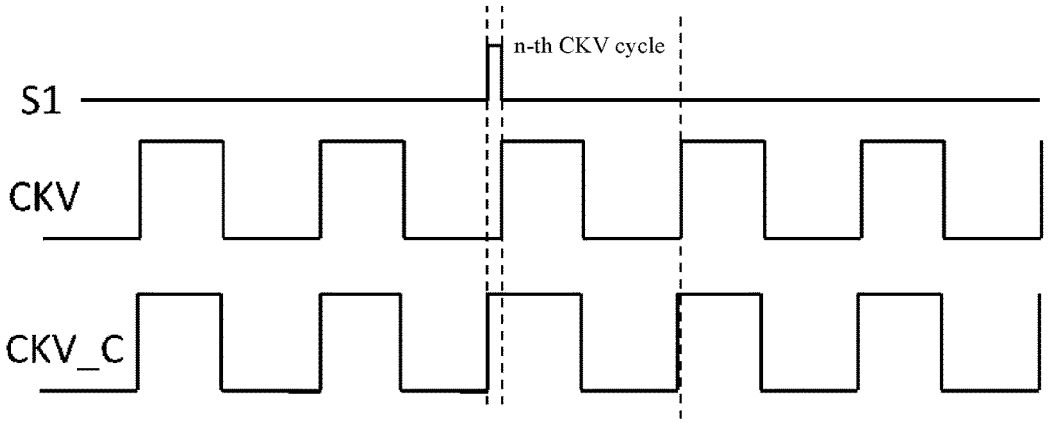
FIG. 3A and FIG. 3B is a illustrative diagram of more general circumstance that using scan compensation method to perform row scan according to the exemplary embodiment of the present disclosure.
Figure 3B:
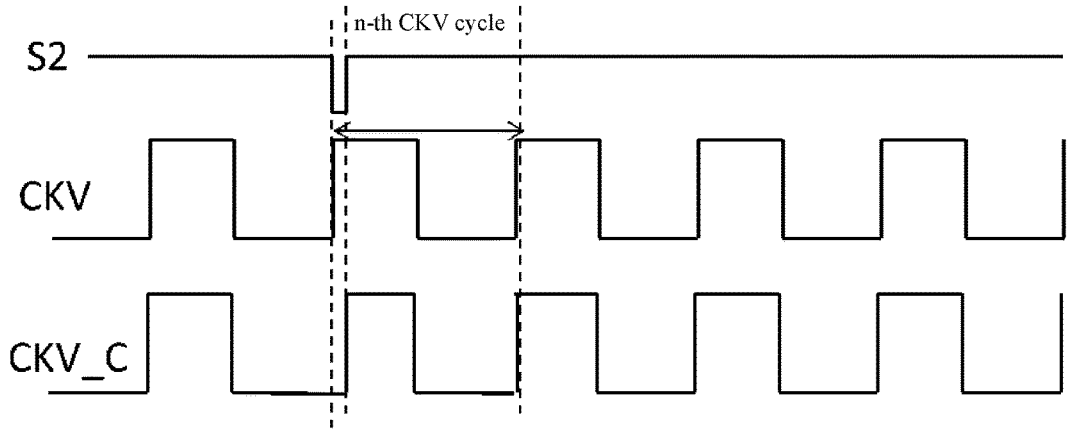

FIG. 3A and FIG. 3B is a illustrative diagram of more general circumstance that using scan compensation method to perform row scan according to the exemplary embodiment of the present disclosure.

Refer to FIG. 3A, when the gate driver is switched between the first scanning mode and the second scanning mode, using the scan compensation method according to the exemplary embodiments of the present disclosure will make scan sequence of the partial row of the plurality of rows changed. In this regard, the m-th row is scanned in n-th order (herein, m and n are positive integer), if m is less than n, aligning the falling edge of the first compensation signal S1 and the rising edge of the waveform of n-th cycle of clock signal of driver. Thus, the result that executing the first operation and the second operation is to reduce the increase degree of potential holding time of m-th row. Otherwise, if m is greater than n, aligning the falling edge of the second compensation signal and the rising edge of the waveform of n-th cycle of clock signal of driver. Thus, the result that executing the first operation and the second operation is to reduce the decrease degree of potential holding time of m-th row. The time of rising edge of the first compensation signal and the time of rising edge of the second compensation signal can be adjusted according to the actual display screen. Therefore, through adjusting the change degree of potential holding time of pixel row caused by switching the scanning mode, which can significant reduce the negative impact of the display screen caused thereof (for example stripe sense, etc.).

Figure 4:
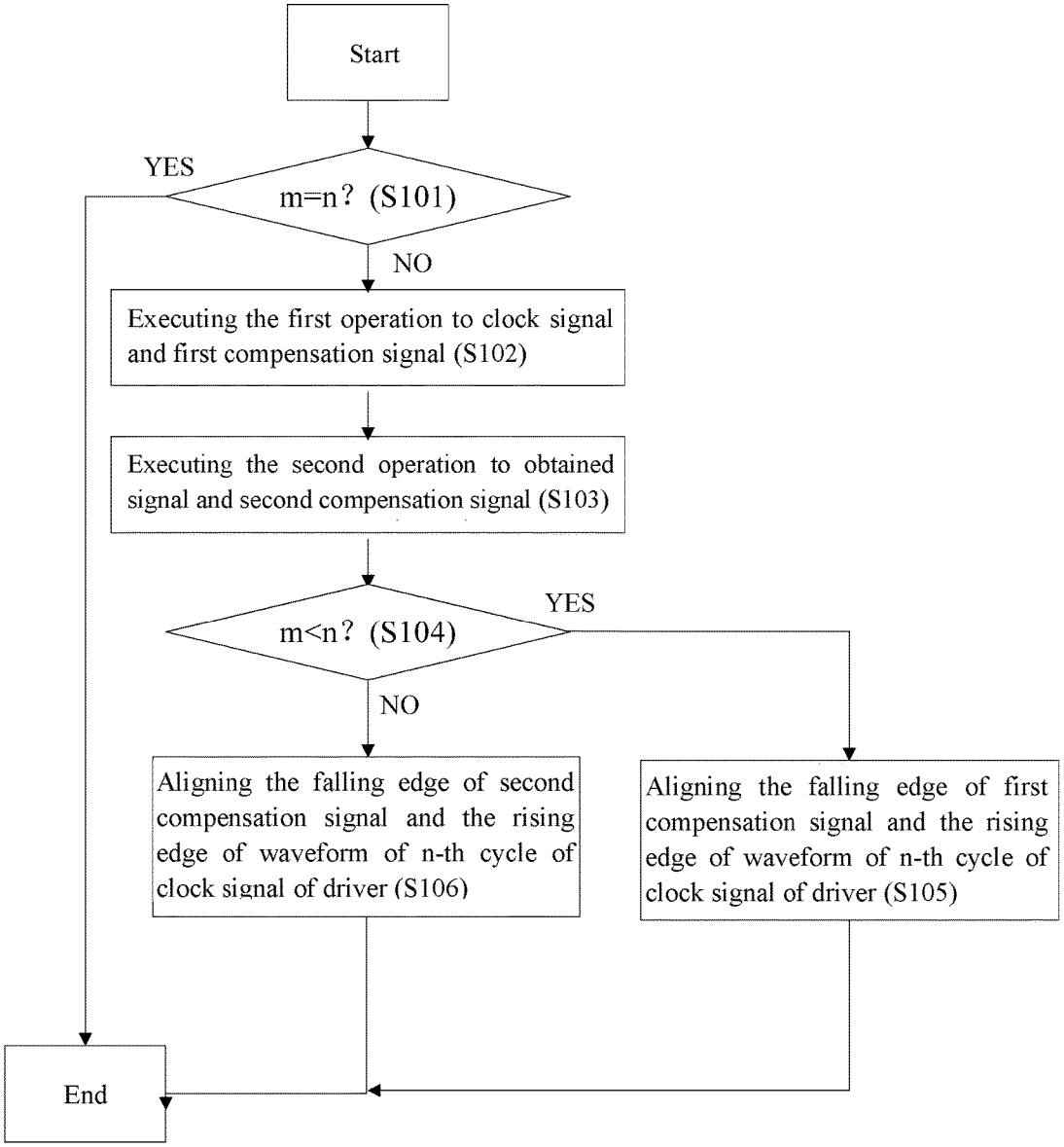
FIG. 4 is a flow chart of the scan compensation method according to the exemplary embodiment of the present disclosure.

FIG. 4 is a flow chart of the scan compensation method according to the exemplary embodiment of the present disclosure.

Refer to FIG. 4, when the scanning mode of gate driver is switched, if m-th row of the plurality of rows of liquid crystal display is scanned in n-th order, in step S101, judging if m is equal to n. Herein, m and n are positive integer. When m is equal to n, not to execute the present method (namely the method goes to end). Because m equal to n means that the scan sequence of the corresponded row will not be changed, the potential holding time will not be changed, thus not affecting the display screen. When m is not equal to n, in step S102, executing the first operation (namely OR operation) to the clock signal of gate driver and the first compensation signal S1. Then, in step S103, executing the second operation (namely AND operation) to the operated signal and the second compensation signal S2 obtained in Step S102. In step S104, judging if m is less than n. if m is less than n, aligning the falling edge of first compensation signal S1 and the rising edge of the waveform of n-th cycle of clock signal of gate driver in step S105. In step S105, since the action of first compensation signal S1, in n-th cycle of clock signal of the gate driver, the triggered time of the operated signal CKV_C is in advance, thus the corresponded row is turned on in advance. The amount of advanced time can be adjusted through adjusting the time of rising edge of the first compensation signal S1, thereby control the degree of turning on in advance of the corresponded row. If m is greater than n, aligning the falling edge of second compensation signal S2 and the rising edge of the waveform of n-th cycle of clock signal of gate driver in step S106. In step S106, since the action of second compensation signal S2, in n-th cycle of clock signal of the gate driver, the triggered time of the operated signal CKV_C is delayed, thus the corresponded row is delayed to turn on. The amount of delayed time can be adjusted through adjusting the time of rising edge of the second compensation signal S2, thereby control the degree of delaying to turn on of the corresponded row.

Figure 5:
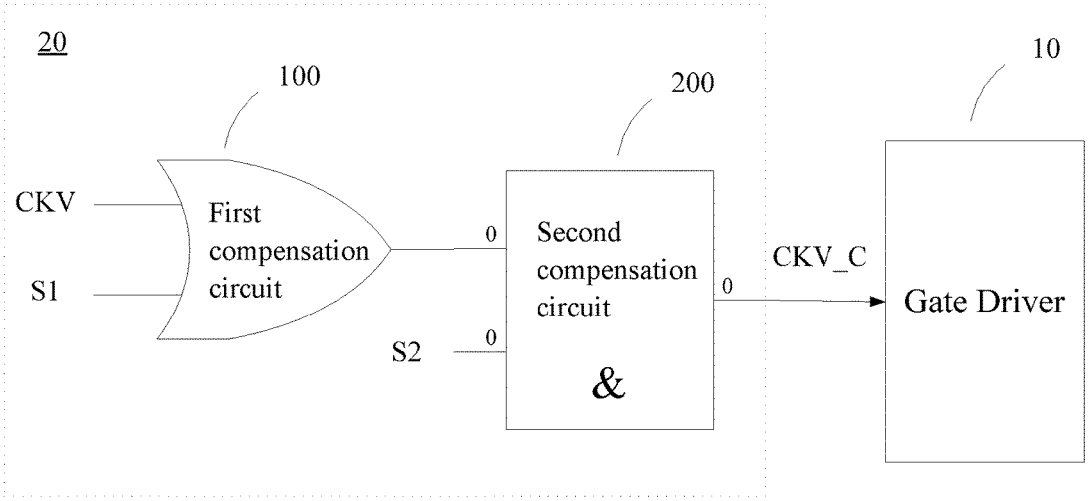
FIG. 5 is a logic diagram of the scan compensation method according to the exemplary embodiment of the present disclosure.

FIG. 5 is a logic diagram of the scan compensation method according to the exemplary embodiment of the present disclosure.

Refer to FIG. 5, the scan compensation circuit 20 comprises a first compensation circuit 100 and a second compensation circuit 200. The first compensation circuit 100 can be OR gate, which can output the clock signal CKV of the gate driver and the first compensation signal S1 to output end of the first compensation circuit 100, the output end of OR gate can output the result signal of OR operation, the result signal can be inputted to the second compensation circuit 200 as an input. The second compensation circuit 200 can be AND gate. The input end of the second compensation circuit 200 receives the output signal of first compensation circuit 100 and the second compensation signal S2, and outing the operated signal CKV_C to the gate driver as a clock signal. Although the present embodiment shows that the first compensation circuit 100 is OR gate and the second compensation circuit 200 is AND gate, the present exemplary embodiment is not limited by this. The first compensation circuit 100 and the second compensation circuit 200 can be other logic circuit with the similar function.

As shown in FIG. 5, the first compensation circuit 100 executes OR operation to the first compensation signal S1 and the clock signal CKV of driver, and the second compensation circuit 200 executes AND operation to the output signal of first compensation circuit 100 and the second compensation signal S2, and outputting the operated signal CKV_C to the gate driver as a clock signal.

As described above, according to the scan compensation method and scan compensation circuit of the gate driver provided by the exemplary embodiments of the present disclosure, which can reduce that the potential holding time affect the display through the row that the potential holding time of liquid crystal capacitor is changed since the scan sequence is changed, improving the stability of liquid crystal display.

According to the exemplary embodiments, the components, elements or at least one of units represented by the block as shown in FIG. 4 are respectively the various number of hardware, software and/or firmware architecture which execute the above functions. For example, components, elements or at least one of these units can be used to direct the circuit configuration can perform their functions by controlling one or more microprocessors or other control devices, such as memory, processing equipment, logical unit, look-up tables. In addition, these components, elements or units can comprise at least one module for performing a specific logical function of one or more executable instructions, procedures, or the specific part of the code is implemented by one or more microprocessors or other control device is executed. In addition, components, elements or at least one of these units may further include performing respective functions such as a central processing unit (CPU), processor, microprocessor or the like. All operations of these units or functions of two or more components, elements or units may be combined into a single component, element or unit, said a separate component, element or unit performs the merger of two or more components, elements or units. In addition, components, elements or at least one of these units at least part of these functions can be performed by the other components, elements or units. Furthermore, although in the above block diagram is not shown in the bus, but the communication between the components, elements or units may be performed via the bus. Algorithm multiple functions above exemplary embodiment can be performed on one or more processors are implemented. Further, the component, element or unit represented by the block may take any number of techniques related art electronics configuration, signal processing and/or control, data processing.

The methods and steps can be performed to execute one or more programmable processors function by one or more computer programs through operating on input data and generating output. The methods and steps can also be special purpose logic circuitry (e.g., an FPGA (field programmable gate array) or an ASIC (application specific integrated circuit)) is performed, and the device may also be implemented as special purpose logic circuitry.

In various embodiments, the computer readable medium may include instructions, when the instruction is executed, the apparatus execute at least one portion of the methods and steps. In some embodiments, the computer readable medium may be included in the magnetic media, optical media, other media or a combination thereof (for example, CD-ROM, hard disk drive, read only memory, flash drives, etc.). In such embodiments, the computer readable medium may be manufactured goods that are tangible and not temporarily achieved.

Those skilled in the art would recognize that while this paper has been illustrated and described in detail a number of exemplary embodiments of the present invention, however, without departing from the spirit and scope of the invention, may be made under this disclosure content directly to determine or derive many other variations or modifications consistent with the principles of the present invention. Therefore, it should be realized that the above embodiments are not to limit, but only exemplary. Therefore, the scope of the inventive concept defined by the appended claims and the broadest permissible interpretation of equivalents to determine, but should not be limited or restricted more specific embodiments. Therefore, it should be realized that the appended claims are intended to cover all modifications fall within the true spirit of the inventive concept and scope of the improvements and other exemplary embodiments.

What is claimed is:

1. A scan compensation method used for a gate driver, wherein the scan compensation method comprises:

when the gate driver switching from first scanning mode to second scanning mode or from second scanning mode to first scanning mode, performing a first operation to a clock signal and a first compensation signal of the gate driver, and performing a second operation to the obtained signals and a second compensation signal, wherein the first scanning mode is a sequential scan mode, the second scanning mode is non-sequential scan mode;

wherein the first operation is OR operation, the second operation is AND operation; and wherein when the gate driver switches from the first scanning mode to the second scanning mode or from the second scanning mode to the first scanning mode, when m-th row of multiple rows of a liquid crystal display is scanned in n-th order, if m is less than n, aligning the falling edge of the first compensation signal and the rising edge of n-th cycle waveform of a clock signal of the driver in order to perform the first operation, if m is greater than n, aligning the falling edge of the second compensation signal and the rising edge of n-th cycle waveform of a clock signal of the driver in order to perform the second operation, if m is equal to n, in n-th cycle of the clock signal of the driver does not perform the first operation or the second operation, wherein n and m are positive integers.

2. A scan compensation method used for a gate driver, wherein the scan compensation method comprises:

when the gate driver switching from first scanning mode to second scanning mode or from second scanning mode to first scanning mode, performing a first operation to a clock signal and a first compensation signal of the gate driver, and performing a second operation to the obtained signals and a second compensation signal, wherein the first scanning mode is a sequential scan mode, the second scanning mode is non-sequential scan mode;

wherein the first compensation signal is use to reduce the degree of corresponding potential retention time increasing which is caused by mode switching of the gate driver, the second compensation signal is used to reduce the degree of corresponding potential retention time which is caused by mode switching of the gate driver decreasing; and wherein when the gate driver switches from the first scanning mode to the second scanning mode or from the second scanning mode to the first scanning mode, when m-th row of multiple rows of a liquid crystal display is scanned in n-th order, if m is less than n, aligning the falling edge of the first compensation signal and the rising edge of n-th cycle waveform of a clock signal of the driver in order to perform the first operation, if m is greater than n, aligning the falling edge of the second compensation signal and the rising edge of n-th cycle waveform of a clock signal of the driver in order to perform the second operation, if m is equal to n, in n-th cycle of the clock signal of the driver does not perform the first operation or the second operation, wherein n and m are positive integers.

3. A scan compensation circuit used for a gate driver, wherein the scan compensation circuit comprises:

a first compensation circuit, which is disposed to perform a first operation to a clock signal and a first compensation signal of the gate driver when the gate driver switching from first scanning mode to second scanning mode or from second scanning mode to first scanning mode;

a second compensation circuit, which is disposed to perform a second operation to output signal of the first operation and a second compensation signal when the gate driver switching from first scanning mode to second scanning mode or from second scanning mode to first scanning mode, wherein the first scanning mode is a sequential scan mode, the second scanning mode is non-sequential scan mode;

wherein the first operation is OR operation, the second operation is AND operation; and wherein when the gate driver switches from the first scanning mode to the second scanning mode or from the second scanning mode to the first scanning mode, when m-th row of multiple rows of a liquid crystal display is scanned in n-th order, if m is less than n, aligning the falling edge of the first compensation signal and the rising edge of n-th cycle waveform of a clock signal of the driver in order to perform the first operation, if m is greater than n, aligning the falling edge of the second compensation signal and the rising edge of n-th cycle waveform of a clock signal of the driver in order to perform the second operation, if m is equal to n, in n-th cycle of the clock signal of the driver does not perform the first operation or the second operation, wherein n and m are positive integers.

4. The scan compensation circuit as claimed in Claim 3, wherein the first compensation signal is use to reduce the degree of corresponding potential retention time increasing which is caused by mode switching of the gate driver, the second compensation signal is used to reduce the degree of corresponding potential retention time which is caused by mode switching of the gate driver decreasing.

* * * * *